United States Patent [19]

Kratt et al.

[11] Patent Number: 5,048,482

[45] Date of Patent: Sep. 17, 1991

[54] DEVICE FOR CONTROLLING AN OPERATING CHARACTERISTIC OF AN INTERNAL COMBUSTION ENGINE

[75] Inventors: Alfred Kratt, Schwieberdingen; Eberhard Lang, Erligheim, both of Fed. Rep. of Germany

[73] Assignee: Robert Bosch GmbH, Stuttgart, Fed. Rep. of Germany

[21] Appl. No.: 477,882

[22] PCT Filed: Aug. 16, 1989

[86] PCT No.: PCT/DE89/00532

§ 371 Date: Apr. 17, 1990

§ 102(e) Date: Apr. 17, 1990

[87] PCT Pub. No.: WO90/02258

PCT Pub. Date: Mar. 8, 1990

[30] Foreign Application Priority Data

Aug. 25, 1988 [DE] Fed. Rep. of Germany ..... 3828850

[51] Int. Cl.[5] ..... F02D 41/12; F02D 41/22; F02D 31/00

[52] U.S. Cl. ..... 123/333; 123/350; 123/399

[58] Field of Search ..... 123/350, 351, 352, 396, 123/397, 399, 333, 332

[56] References Cited

U.S. PATENT DOCUMENTS

| | | | |
|---|---|---|---|
| 3,777,174 | 12/1973 | Butscher et al. | 123/350 |
| 3,916,854 | 11/1975 | Barton | 123/350 |
| 4,278,059 | 7/1981 | Collonia | 123/399 |
| 4,305,359 | 12/1981 | Mann et al. | 123/333 |
| 4,311,123 | 1/1982 | Glöckler et al. | 123/325 |
| 4,461,254 | 7/1984 | Pfalzgraf et al. | 123/396 |
| 4,549,519 | 10/1985 | Horbelt et al. | 123/493 |
| 4,569,320 | 2/1986 | Collonia | 123/399 |
| 4,635,607 | 1/1987 | Yasuoka et al. | 123/479 |

FOREIGN PATENT DOCUMENTS

| | | |
|---|---|---|
| 0089409 | 9/1983 | European Pat. Off. . |
| 0147611 | 7/1985 | European Pat. Off. . |
| 0205916 | 12/1986 | European Pat. Off. . |
| 2556415 | 6/1985 | France . |

*Primary Examiner*—Andrew M. Dolinar
*Attorney, Agent, or Firm*—Walter Ottesen

[57] ABSTRACT

A device for controlling an operating characteristic of an internal combustion engine is suggested with a speed limitation being effective according to a predetermined time function by influencing the fuel metering during the transition from the idling state to the driving mode. This speed limitation is activated especially in the event of a fault of the actuating device, of its activation and of the feedback and in the event of a speed response critical to safety in the idling state.

13 Claims, 2 Drawing Sheets

FIG. 2
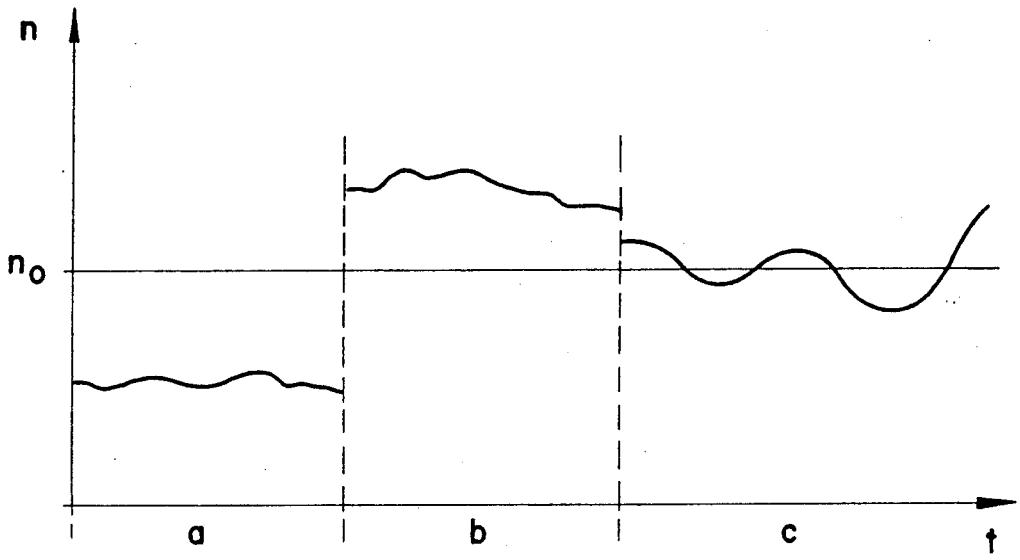
FIG. 3a
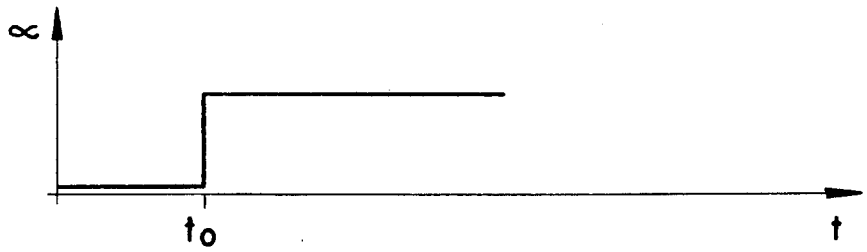
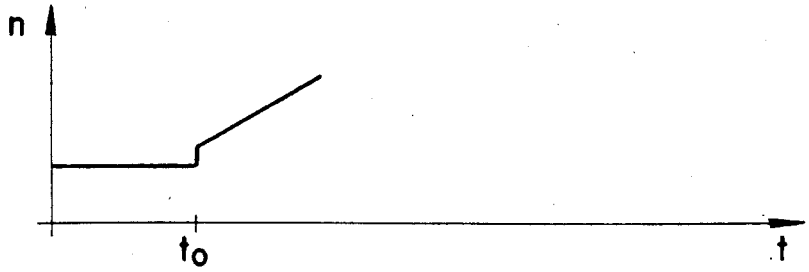
FIG. 3b

DEVICE FOR CONTROLLING AN OPERATING CHARACTERISTIC OF AN INTERNAL COMBUSTION ENGINE

FIELD OF THE INVENTION

The invention relates to a device for controlling an operating characteristics of an internal combustion engine.

BACKGROUND OF THE INVENTION

A device of this type for controlling an operating characteristic of an internal combustion engine is known from U.S. Pat. No. 4,635,607. There, a fuel-metering system is presented with an actuator for influencing the supply of air to the internal combustion engine, with means which detect a driving condition critical to safety by checking the drive signal of the air-influencing actuator with respect to limit values. Furthermore, this means detects a fluctuation of the idling speed by checking the speed as a function of time and the means also, in the presence of a driving condition critical to safety, modifies the condition for fuel cut-off in such a way that, increasing linearly as a function of speed, this condition is still valid for openings of the throttle flap of up to 5°.

Moreover, it is known from U.S. Pat. No. 4,311,123 to increase the fuel quantity according to a selectable time function by opening the idling contact after deceleration has ended. This allows a smooth transition to the normal driving mode.

Furthermore, it is known from U.S. Pat. No. 4,305,359 to detect a defect of the actuator for guidance control by checking the actuator position and accelerator-pedal position. A defect is assumed when the accelerator pedal is in the idling position and the actuator, especially the throttle flap, is outside its idling position. When such a defect is present, the fuel supply is cut off in order to reduce the speed. When the driver moves the accelerator pedal out of its idling position again, the cut-off of the fuel supply is cancelled in order to avoid driving conditions critical to safety. The speed of the internal combustion engine can thereby be increased again.

However, it is a disadvantage that, when the throttle is opened, the sudden torque jump can give rise to an undesirable vehicle acceleration, with the result that the driver is possibly no longer in control of the situation.

It is the object of the invention to improve the driving performance during the transition from the idling mode to the driving mode in a device for controlling an operating parameter of an internal combustion engine of the type mentioned above and to prevent driving conditions critical to safety.

Furthermore, a method for controlling the fuel-metering system of an internal combustion engine in the overrun mode is known from U.S. Pat. No. 4,549,519. There, the actual speed is compared with a predetermined speed threshold value which is reduced from a high initial value to a low final value according to a time function. If the actual speed is above this speed threshold, the fuel supply is cut off. Conversely, when the speed is lower than this speed threshold value, the fuel supply resumes. The transition from the overrun mode to the normal operating state is not described herein.

In the following, the term "idling state" covers all the operating states in which the accelerator pedal or throttle flap are in their idling position, especially the overrun mode.

SUMMARY OF THE INVENTION

The device according to the invention improves the driving performance of an internal combustion engine in the event of a defective state of the actuator controlling the air throughput, of its activating devices and lines and of its feedback devices and lines during the transition from the idling state to the normal driving mode by controlling a speed limitation by fuel cut-off according to a predetermined time function. A torque jump which could be critical to safety and which can occur under specific operating conditions, is effectively prevented.

In particular, in the above-mentioned event of a defect, the device according to the invention is capable of overcoming driving conditions critical to safety and of maintaining a reliable operation of the internal combustion engine. The invention starts from the fact that, in the event of a defect, a driving condition critical to safety is to be expected only when, in the idling state, the speed oscillates about the predetermined speed threshold value for the fuel cut-off.

Furthermore, the device according to the invention can also be used other than when a defect is present, especially after the overrun mode of operation. Fuel cut-off also means the elimination of individual injection pulses.

BRIEF DESCRIPTION OF THE DRAWINGS

The invention is explained below with reference to the embodiment shown in the drawings.

FIG. 2 shows possible speed responses with the occurrence of the above-described defects and an effective fuel cut-off above a speed threshold. FIGS. 3*a* and 3*b* represent a possible response of the speed limitation as a function of the position of the throttle flap or of the accelerator pedal.

DESCRIPTION OF THE PREFERRED EMBODIMENTS OF THE INVENTION

Figure 1:
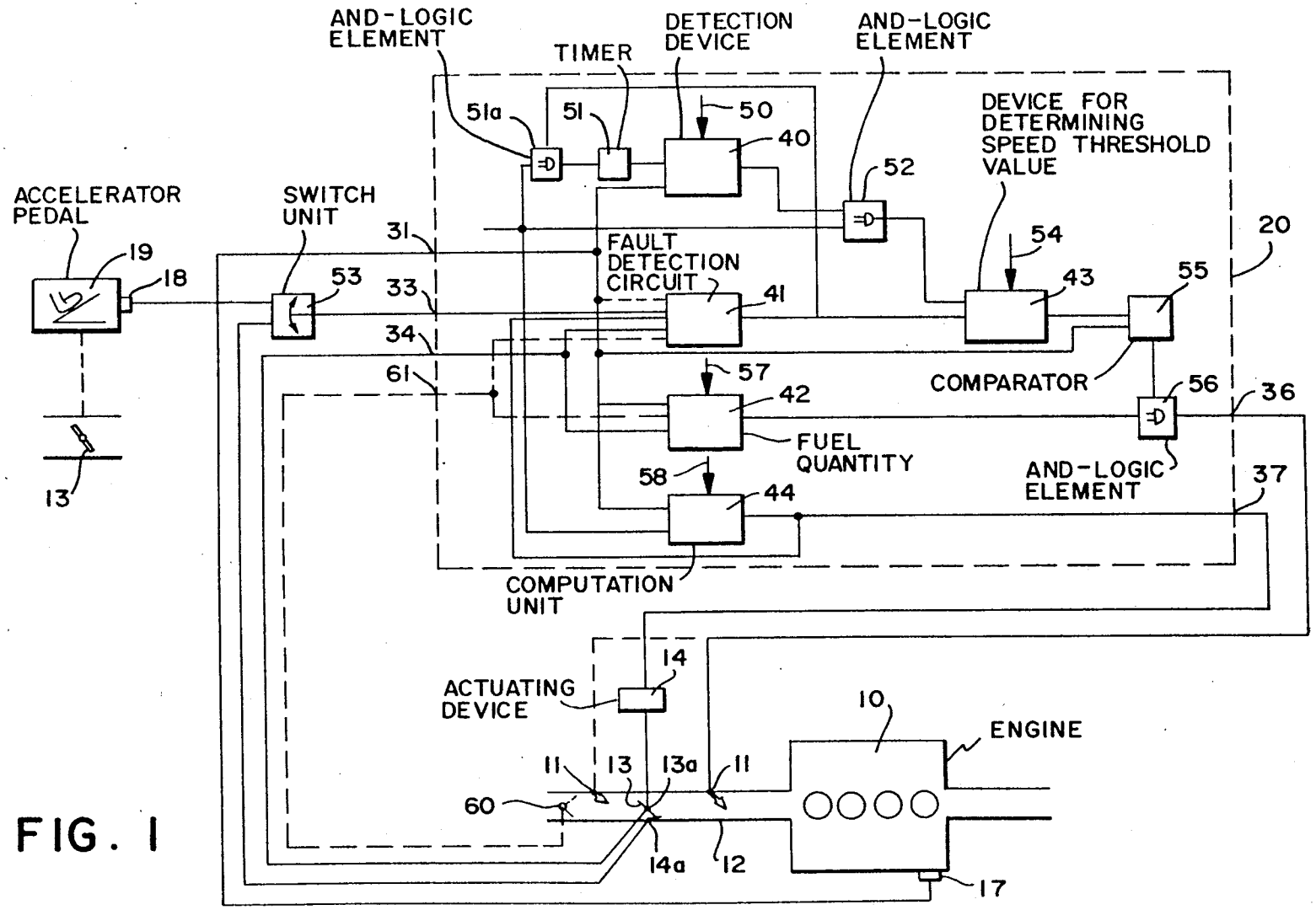
FIG. 1 shows a schematic representation of the device according to the invention.

FIG. 1 shows an internal combustion engine 10 with at least one fuel-injection valve 11 and an intake pipe 12, in which a throttle flap 13 with a throttle-flap position transducer 13*a*, an actuating device 14 setting the throttle flap and an idling switch 14*a* are located. The illustrated device also has a speed sensor 17 and a position transducer 18 of an accelerator pedal 19 which controls the throttle flap 13 and to which a switch for the zero position of the accelerator pedal is assigned. A control unit 20 receives via its input 31 the actual speed from the speed sensor 17, via its input 33 the idling signal and via its input 34 the throttle-flap position from the throttle-flap position transducer 13*a*. The idling signal can be picked up either from the idling switch 14*a* or from the accelerator-pedal position transducer 18, as represented symbolically in FIG. 1 by the switch unit 53. The input 33 of the control unit 20 is connected to these transducers 14*a* and 18 via the switch unit 53.

Via outputs 36 and 37 of the control unit 20, the operating characteristic fuel quantity is controlled via a corresponding activation for at least one injection valve 11 and the operating characteristic idling air-throughput is controlled via the actuating device 14 of the throttle flap 13.

The control unit 20 consists essentially of a device 40 for detecting a driving condition critical to safety, of a fault detection circuit 41, of a computation unit for the fuel quantity 42, of a device 43 for determining the speed threshold value for the fuel cut-off and of a computation unit 44 for actuating the adjusting device 14. These devices are assigned to individual regions of the control unit.

The input signals of the device 40 for detecting a driving state critical to safety are the engine speed and a speed threshold value predetermined via the feed line 50. Furthermore, the device 40 is connected to a timer 51. The output of this device 40 is connected via an AND-logic element 52 to the device 43 for forming the speed limiting value. The second input of the AND-logic element 52 receives the idling signal via the input 33.

The fault detection circuit 41 processes as input signals the idling signal, the output signal of the computation unit 44 and the throttle-flap position. Its single output is connected to the device 43 for forming the speed limiting value and, via an AND-logic element 51*a* linked to the idling signal, to the timer 51. In addition to the above-described input signals, the device 43 has via a feed line 54 a further input signal which considers various operating conditions of the internal combustion engine. The output of the device 43 is connected to an AND-logic element 56 via a comparator device 55. The second input of the comparator device 55 receives the speed signal from the input 31. The speed and throttle-flap position are supplied to the computation unit 42 for the fuel-metering signal and the output of the computation unit 42 is connected to the second input of the AND-logic element 56. The feed line 57 of the computation unit 42 represents further operating characteristics which are required for computing the fuel-metering signal. By these are meant especially the temperature and the exhaust-gas composition. The computation unit 44 forms the activating signal for the actuating device 14 from the idling signal and speed. Further operating characteristics, such as are known from idling controls, are fed to the computation unit 44 via a feed line 58. The output of the AND-logic element 56 is connected to the output 36 of the control unit 20 and therefore to the fuel valve 11 of the internal combustion engine, and the output of the computation unit 44 is connected to the adjusting device 14 via the output 37 of the control unit 20.

The device 40 is activated by the fault detection circuit 41 and by the idling signal from the input 33 and checks the speed trend of the internal combustion engine by comparing the speed with a predetermined threshold value. During predetermined time intervals determined by the timer 51, the device 40 detects from the results of the comparison whether there are speeds higher and lower than the speed threshold value. If the internal combustion engine is in the idling state which is taken into account by the logic element 52 and which uses the idling signal as a second input variable, then the device 43 for determining the speed limiting value is addressed according to the result of the check of the speed response in the device 40.

The fault detection circuit 41 detects abnormal operating states as a function of the throttle-flap position, the magnitude of the activating signal for the actuating device 14 and the idling signal. The throttle-flap position is compared with a computed desired value. It is thus possible to consider all the faults in which the opening of the air-throughput actuator 13 can no longer be reduced and therefore remains inadmissibly large. When a fault is detected, the fault detection circuit 41 activates the device 43 for forming the speed limiting value and, via the AND-logic element 51*a* and the timer 51, the device 40.

FIG. 2 shows the possible speed responses in the idling state of the internal combustion engine in the event of a fault. The predetermined speed value, designated by $n_o$ in FIG. 2 and fed to the device 40 via the feed line 50, is selected high enough to ensure that it is above the normal speed. As shown in FIG. 2*a*, the speed can constantly be below the speed threshold value 50 during the time interval predetermined by the timer 51. In this case, the detected fault does not have a serious effect on the speed, that is, the opening of the actuator 13 is, for example, not inadmissibly wide, or the engine is subjected to a high load by mechanical or electrical consumers. No behavior critical to safety is therefore to be expected during the transition from the idling state into another operating state of the internal combustion engine. In this case, the device 43 is consequently cut off outside the idling state. In FIG. 2*b*, the speed is constantly higher than the speed threshold value. From this speed response with a fuel cut-off it is concluded that the vehicle is in the overrun mode. Here too, the device 43 according to the invention is not active outside the idling state, since an immediate take-up without an interruption of torque is desirable. Because of the fuel cut-off above the speed threshold there is therefore a driving condition critical to safety only when, as shown in FIG. 2*c*, the speed oscillates about the speed threshold value. In this case, the device 43 according to the invention must supply a speed limiting value even outside the idling state. The device 43 therefore transmits a speed limiting value with the opening of the idling switch when, in the idling state, there is a fault detection signal from the circuit 41 and the device 40 has additionally detected an oscillation of the speed about the speed threshold value 50.

FIG. 3*b* shows the trend of the speed limiting value in and outside the idling state when the last-mentioned case occurs. Thus, if the idling switch is opened at the time $t_o$ or the accelerator pedal shifted, as in FIG. 3*a*, then the device 43 increases the speed limiting value slightly and raises it according to a time function. A limit value determines the maximum speed limiting value. In FIG. 3*b*, a ramp function is shown as a time function.

The comparator device 55 constantly compares the speed limiting value with the speed and cuts off the fuel supply via the logic element 56 when the speed is higher than the speed limiting value and cuts in the fuel when the speed falls below the speed limiting value.

Advantageous other embodiments of the device according to the invention are described below.

Besides the embodiment shown in FIG. 1, which was chosed merely for the sake of clarity, the procedure described can also be carried out in a computer.

In order to extend the fault detection, an air-mass meter 60 can be used additionally in the device according to the invention. This air-mass meter 60 transmits an air-mass signal 61 to the fault detection circuit 41 and to the computation unit 42 for fuel metering. Moreover, the speed signal can also be processed for fault detection.

Furthermore, instead of one speed threshold value, it is possible to predetermine two separate speed threshold values with an intermediate speed band for fuel cut-off and cut-in. Speed oscillation is detected when speed values occur above and below this speed band.

Moreover, speed oscillation can be determined by detecting alternately positive and negative speed gradients as a function of a predetermined limit value and of a predetermined speed.

Of course, the time function for raising the speed limiting value is not restricted to the ramp function described in the exemplary embodiment. Thus, any time function can be realized in dependence on the operating states of the internal combustion engine. In particular, this time function can be dependent on parameters such as the actuating speed of the accelerator pedal or of the throttle flap, or on the driving speed. In FIG. 1, this is taken into account by the additional input 54 of the device 43 for determining the speed limiting value. A dependence of this speed limiting value on the actuating speed of the accelerator pedal means that, even in the event of a fault, the internal combustion engine reacts to the driver's wishes outside the idling state.

In an extension of the exemplary embodiment, in the event of a fault, the check of the speed response is independent of the position of the idling switch 14*a*.

Moreover, a general presetting of a minimum reinjection speed and a maximum cut-off speed can ensure that emergency operation is limited to a speed band predetermined thereby.

Of course, the device according to the invention also includes the control of an operating characteristic of an internal combustion engine with a bypass channel and an adjusting device controlling the air throughput in this bypass channel.

The device according to the invention can also be used analogously after the overrun mode in a way corresponding to the above exemplary embodiment.

Furthermore, the idling signal can also be picked up directly from the throttle-flap position transducer 13*a*.

In summary, it is found that the device described first detects the fault, then activates the speed limiting value $n_o$ in the idling state and thereafter checks for a driving condition critical to safety. If this check is positive, according to the invention the speed limitation is increased during the transition from the idling state or overrun mode to the driving mode.

We claim:

1. An arrangement for controlling an operating parameter of an internal combustion engine having an air-intake pipe, the arrangement comprising:

actuating means for adjusting the air through-put passing to the engine through said intake pipe with said actuating means being adjustable to correspond to an idle condition of the engine and a drive condition of the engine;

idle-condition detection means for detecting the adjustment of said actuating means corresponding to said idle condition;

control means for controlling the fuel metered to the engine;

drive-condition detection means for detecting a drive condition critical to safety produced by a fault in said actuating means for adjusting the air flow to the engine during idle;

engine speed limiting means operatively connected to said control means and being actuable by said drive-condition detection means for limiting the speed of the engine; and, said engine speed limiting means being effective in said idle condition and said drive condition and being adapted to emit an engine speed limit value increasing as a function of time as the engine passes from said idle condition to said drive condition.

2. The arrangement of claim 1, wherein said drive-condition detection means checks the engine speed response in said idle condition and activates said engine speed limiting means in both said idle condition and said drive condition in response to an oscillation of the engine speed.

3. The arrangement of claim 1, wherein the engine speed limit value follows a pregiven time function when the accelerator pedal or the throttle flap is actuated.

4. The arrangement of claim 3, wherein said time function is a ramp function.

5. The arrangement of claim 1, wherein said drive-condition detection means checks the engine speed response independently of the idle condition after a fault detection.

6. An arrangement for controlling an operating parameter of an internal combustion engine having an air-intake pipe, the arrangement comprising:

actuating means for adjusting the air through-put passing to the engine through said intake pipe with said actuating means being adjustable to correspond to an idle condition of the engine and a drive condition of the engine;

idle-condition detection means for detecting the adjustment of said actuating means corresponding to said idle condition;

control means for controlling the fuel metered to the engine;

drive-condition detection means for detecting a drive condition critical to safety;

engine speed limiting means operatively connected to said control means and being actuable by said drive-condition detection means for limiting the speed of the engine;

said engine speed limiting means being effective in said idle condition and said drive condition and being adapted to emit an engine speed limit value increasing as a function of time as the engine passes from said idle condition to said drive condition; and, means for detecting a fault of said actuating means influencing the air throughput, and detecting the drive of said actuating means or the feedback of said actuating means in the idle condition and said engine speed limiting means being effective as a function of this fault.

7. The arrangement of claim 6, wherein a fault is detected by a check of the throttle-flap position in the idle condition with a plausibility comparison between actual value and activating value being carried out.

8. The arrangement of claim 7, wherein an air-mass measurement signal or an engine speed signal is additionally processed for fault detection and is included in the plausibility check.

9. An arrangement for controlling an operating parameter of an internal combustion engine having an air-intake pipe, the arrangement comprising:

actuating means for adjusting the air through-put passing to the engine through said intake pipe with said actuating means being adjustable to correspond to an idle condition of the engine and a drive condition of the engine;

idle-condition detection means for detecting the adjustment of said actuating means corresponding to said idle condition;

control means for controlling the fuel metered to the engine;

drive-condition detection means for detecting a drive condition critical to safety;

engine speed limiting means operatively connected to said control means and being actuable by said drive-condition detection means for limiting the speed of the engine;

said engine speed limiting means being effective in said idle condition and said drive condition and being adapted to emit an engine speed limit value increasing as a function of time as the engine passes from said idle condition to said drive condition; and, comparator means for detecting an oscillation of the engine speed by successive comparisons of the actual engine speed (n) with a predetermined threshold value ($n_t$).

10. The arrangement of claim 9, wherein drive-condition detection means are adapted to check the speed response during predetermined time intervals.

11. The arrangement of claim 9, wherein said oscillation of the engine speed is detected by alternating speed gradients as a function of a limit value and of a pregiven engine speed.

12. The arrangement of claim 9, wherein the speed threshold value is configured as a speed band with a higher cut-off speed and a lower resumption speed.

13. An arrangement for controlling an operating parameter of an internal combustion engine having an air-intake pipe, the arrangement comprising:

actuating means for adjusting the air through-put passing to the engine through said intake pipe with said actuating means being adjustable to correspond to an idle condition of the engine and a drive condition of the engine;

idle-condition detection means for detecting the adjustment of said actuating means corresponding to said idle condition;

control means for controlling the fuel metered to the engine;

drive-condition detection means for detecting a drive condition critical to safety;

engine speed limiting means operatively connected to said control means and being actuable by said drive-condition detection means for limiting the speed of the engine;

said engine speed limiting means being effective in said idle condition and said drive condition and being adapted to emit an engine speed limit value increasing as a function of time as the engine passes from said idle condition to said drive condition; and, said engine speed limit value following a pregiven time function when the accelerator pedal or the throttle flap is actuated and said engine speed limit value assuming different responses in dependence on the actuating speed of the accelerator pedal, on the throttle flap or on the driving speed of the vehicle.

* * * * *